United States Patent [19]

Quinn

[11] Patent Number: 5,031,724

[45] Date of Patent: Jul. 16, 1991

[54] SHORING FRAME PILLAR

[75] Inventor: Brian R. Quinn, Encinitas, Calif.

[73] Assignee: James E. Wright, San Diego, Calif.

[21] Appl. No.: 458,987

[22] Filed: Dec. 29, 1989

[51] Int. Cl.[5] ..... E04G 1/12; E04G 11/48

[52] U.S. Cl. ..... 182/179; 182/178

[58] Field of Search ..... 182/178, 179; 52/738, 52/739, 638, 637, 639; 248/354.3

[56] References Cited

U.S. PATENT DOCUMENTS

| | | | |
|---|---|---|---|
| 2,126,811 | 8/1938 | Rambo | 182/179 |
| 2,467,668 | 4/1949 | Hallberg | 52/738 |
| 3,190,405 | 6/1965 | Squire | 182/178 |
| 3,564,803 | 2/1971 | Breeze | 182/178 |
| 3,856,421 | 12/1974 | Nogler | 248/354.3 |
| 4,194,338 | 3/1980 | Trafton | 52/738 |
| 4,408,431 | 10/1983 | D'Alessio | 182/179 |
| 4,481,748 | 11/1984 | D'Alessio | 182/179 |
| 4,813,196 | 3/1989 | Bokelund | 52/738 |

FOREIGN PATENT DOCUMENTS

| | | | |
|---|---|---|---|
| 49096 | 7/1982 | European Pat. Off. | 182/178 |

OTHER PUBLICATIONS

The Aluma Frame (brochure) Aluma Systems Corp. 7/1987.

*Primary Examiner*—Reinaldo P. Machado

*Attorney, Agent, or Firm*—Henri J. A. Charmasson

[57] ABSTRACT

A pillar used as part of a shoring, decking or scaffolding frame is made from length of aluminum extrusion having an octagonal periphery with a plurality of internal radial projections whose ends jointly define an unencumbered axial channel dimensioned to receive at either end, the threaded stem of height-adjustment screw-jacks, without need of any screw-jack-mounting sleeves or other screw-jack-centering and holding device.

9 Claims, 1 Drawing Sheet

FIG. 1
PRIOR ART
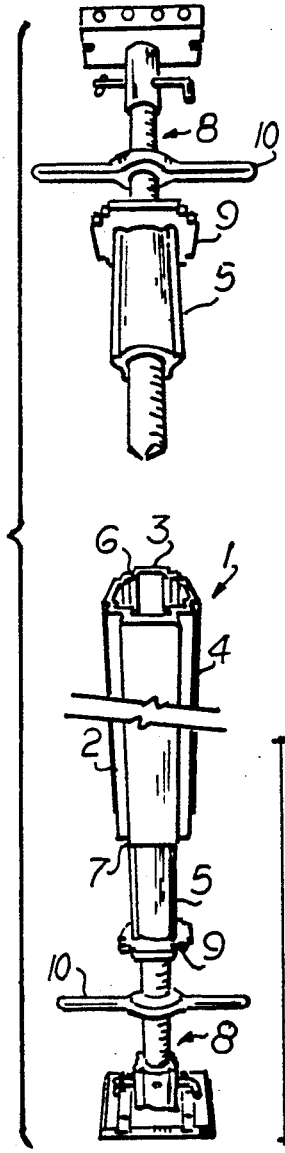
FIG. 3
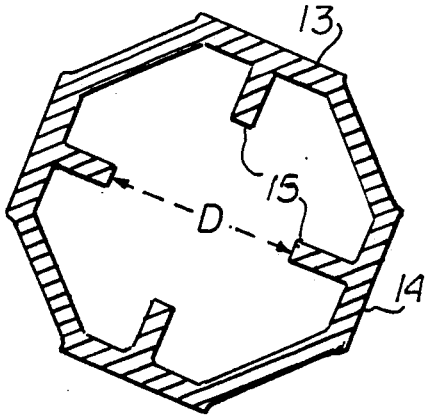
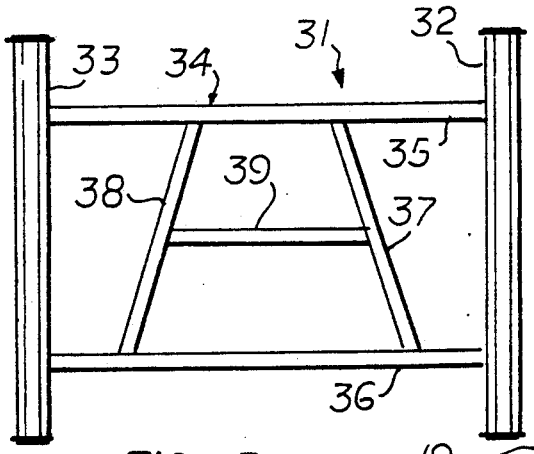
FIG. 5
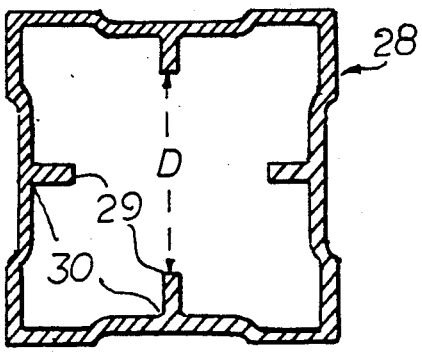
FIG. 4
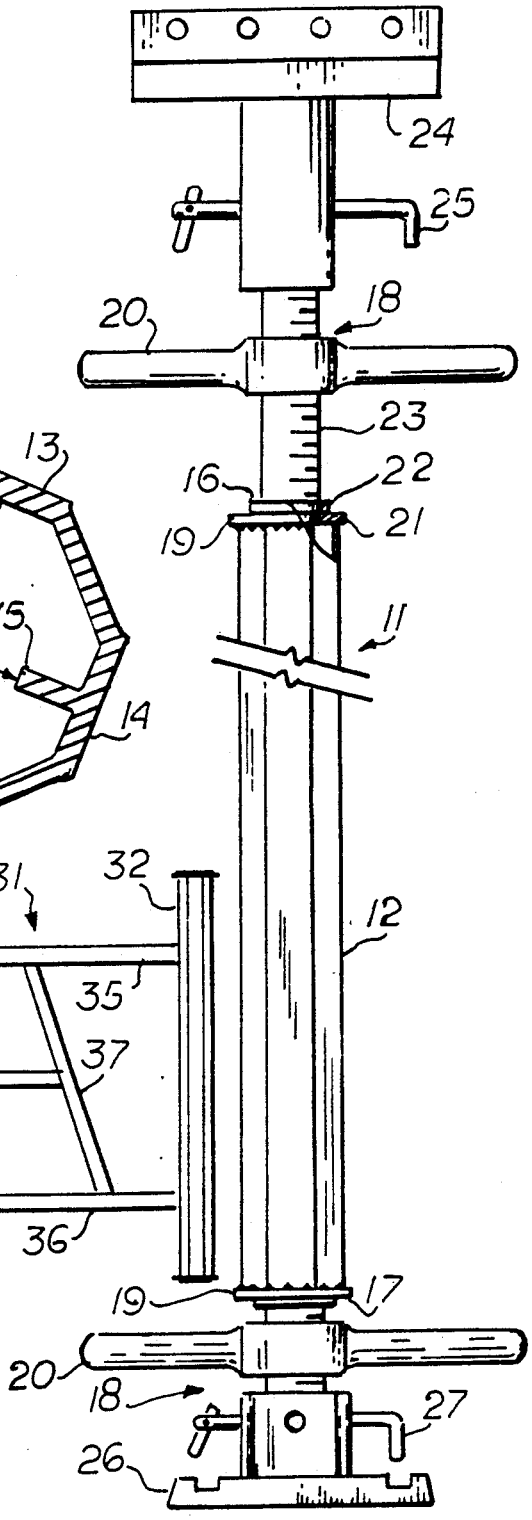
FIG. 2

SHORING FRAME PILLAR

BACKGROUND OF THE INVENTION

This invention relates to scaffolding, decking and shoring frameworks used in building construction.

Standard framing elements have been developed which can be used repetitively on construction sites in a variety of shoring applications. One of the most common shoring frame configurations comprises two vertical pillars joined together by a brace. That brace is usually made of a top and bottom transom and at least one oblique strut. The shoring frames are offered in a variety of sizes. Screw-jacks are mounted at both ends of the pillars for height adjustment.

The industry has strived to provide shoring frames with the highest strength-to-weight ratio, maximum convenience in mounting and dismounting complex frameworks, versatility of use, and extended durability. One of the most advanced examples of shoring frames is described in the Aluma Frame brochure published in 1987 by Aluma Systems Corp., of Toronto, Canada.

A shoring framework pillar of the prior art is illustrated in FIG. 1. The pillar 1 comprises a section of hollowed, tubular extrusion 2 having a generally square cross-section. The resistance of the pillar to bending forces due to axial or shearing loads has been improved by ribbing the four walls 3 in a variety of right angle folds. This tubular construction maximizes the load capacity of the pillar by distributing the weight on its peripheral wall. Screw-jack sleeves 5 are inserted into the top end 6 and the bottom end 7 of the pillar. The sleeves have an external diameter commensurate with the internal diameter of the pillar and an internal diameter commensurate with the standard two-inch (5.08 cm) diameter of screw-jacks 8. Each sleeve is capped with a plate shaped and dimensioned to match the transversal outline of the pillar. The plates 9 provides a bearing surface for the handles 10 of the screw jacks. The sleeves 5 are not permanently connected to the pillars, but must be provided and used with each screw-jack.

There is a need for an improved shoring frame pillar which would equal or exceed the load capacity of the pillars of the prior art, but would eliminate the need for top and bottom screw-jack sleeves. These screw-jack sleeves are added components which increase weight and complexity of shoring frames, and can be easily misplaced on building sites.

SUMMARY OF THE INVENTION

The principal and secondary objects of the present invention are to provide a type of pillar in shoring frames used in the construction industry which has an improved load capacity and resistance to shearing forces, and which eliminates the need for end-sleeves to receive height adjusting top and bottom screw-jacks.

These and other objects are achieved by a pillar made from a section of hollowed, tubular extrusion having a polygonal cross-section. Radial ribs extend internally from some of the sides of the polygonal walls toward the center of the pillar to define an internal, unencumbered channel sized to receive the threaded stems of screw-jacks without need for any centering sleeve element.

BRIEF DESCRIPTION OF THE DRAWING

FIG. 1 is an exploded perspective view of a pillar typical of the prior art;

FIG. 2 is a front elevational view of a pillar of the preferred embodiment of the invention;

FIG. 3 is a cross-sectional view of the pillar;

FIG. 4 is a cross-sectional view of an alternate embodiment of the pillar; and FIG. 5 is a front elevational view of a shoring frame according to the invention.

DESCRIPTION OF THE PREFERRED EMBODIMENT OF THE INVENTION

Referring now to the drawing, there is shown in FIG. 2 a pillar 11 made from a section 12 of hollowed, aluminum extrusion. The wall 13 of the extrusion has a polygonal configuration illustrated in FIG. 3. The wall comprises eight sides 14, this octagonal configuration is preferred to a quadrangular configuration because it spreads the axial load farther away from the center of the pillar as would be best achieved by a circular wall, but retains a high resistance to shear forces by means of its angular configuration.

Radial ribs 15 extend internally from the top end 16 through the bottom end 17 of the pillar to define at their tips an internal diameter of approximately two inches (5.08 cm). Thus forming an unencumbered internal channel to mount screw-jacks 18 at either end of the pillar. Washer-like plates 17 are welded at each end of the pillar to serve as bearing surfaces for the handles 20 of the screw-jacks.

As seen in the cutout portion of FIG. 2, each plate 17 comprises a bottom washer whose outside diameter is commensurate with the diameter of the extruded section 12, and a top washer 22 whose outside diameter is generally commensurate with the internal diameter of the extruded section. The top washer is welded or integral to the bottom washer. The common inner diameter of the top and bottom washers is commensurate with the internal unencumbered channel defined by the ribs 15. The threaded stem 23 of a screw-jack can thus be inserted into the top end of the pillar 11 with the handle 20 resting against the plate 17, the upper end of the threaded stem 23 is inserted into the stem of a shoring head 24, and secured by a toggle pin 25. Similarly, the threaded stem of a second screw-jack can be inserted in the bottom end of the pillar 11 and secured to a base plate 26 with another toggle pin 27. There is no need for the sleeves 5 or bearing caps of the prior art.

In an alternate embodiment of the invention the pillar 11, the extruded aluminum section has a quadrangular cross-section 28 illustrated in FIG. 4 with radial ribs 29 extending from the middle 30 of each side of the quadrangular wall of the pillar.

The radia ribs 15, 29 in either embodiment of the pillar not only define the screw-jack mounting channel, but also support some of the load and increases the resistance of the pillar to any flexional or torsional movement. Each pillar may be seen as a combination of four T-beams joined together in a tubular configuration.

The preferred configuration of a shoring frame 31 using the preferred or alternate embodiment of the pillar just described is illustrated in FIG. 5. The two parallel pillars 32, 33 are joined by a brace 34 comprising a top transom beam 35 and a bottom transom beam 36. The two transom beams are parallel to each other, and perpendicularly connected to the upper and bottom sections of the pillars respectively. Two upwardly-converging, oblique struts 37 and 38 are connected between the top and bottom transom beams, a middle transom beam 39 parallel to the top and bottom transom beams connect the two strut beams at mid-height of the frame.

The configuration of the brace 34 has been found superior to the bracing configuration used in the prior art in its resistance to shear load; thus, allowing a larger spread between the pillars 32, 33 than could be tolerated using the bracing configuration of the prior art.

In the preferred embodiment of the invention, the section of aluminum extrusion 12 is characterized by an external diameter of 3.75 inches (9.39 cm). The thickness of the wall 13 ranges from 0.125 to 0.135 inches (0.3175 to 0.338 cm). The thickness of the ribs 15 ranges from 0.20 to 0.30 inches (0.508 to 0.75 cm). The top washer 22 of the plate 17 is made from 0.375 inch (0.939 cm) thick aluminum. The top washer 21 is made from 0.125 inch (0.256 cm) thick steel. The ultimate load capacity of a six foot (1.8 meter) high pillar was found to exceed 18 tons.

While the preferred and alternate embodiments of the invention have been described, modification can be made and other embodiments can be devised without departing from the spirit of the invention and the scope of the appended claims.

What is claimed is:

1. In combination with a scaffolding, decking or shoring framework wherein screw-jacks are used as height-adjustable ends, and each of said screw-jacks comprises a hand-operable bearing nut and a threaded spindle engaging said bearing nut, a pillar which comprises:

a section of hollowed tubular extrusion, said tubular extrusion having:

a peripheral weight-bearing wall;

a plurality of radial ribs extending inwardly and internally from said wall throughout the length of said section to a plurality of distal edges defining an unencumbered axial channel dimensioned to position and hold a length of spindle of one of said screw-jacks at the center of either extremity of said section; and a bearing plate at each extremity of said section in a plane normal to the axis of said section, said plate having the shape of a washer, an external diameter generally commensurate with the other diameter of said section and an internal diameter at least as large as the cross-diameter of said spindle.

2. The combination of claim 1, wherein the cross-section of said peripheral wall defines a polygon.

3. The combination of claim 2, wherein said polygon has at least four sides.

4. The combination of claim 3, wherein said radial ribs extend from the middle of some of said sides.

5. The combination of claim 4, wherein said cross-section defines an octagon; and one of said radial ribs extends from each of four non-contiguous sides of said octagon.

6. The combination of claim 5, wherein said radial ribs generally have the same thickness as the wall.

7. The combination of claim 1, wherein said framework comprises:

two of said pillars joined together in a parallel and spaced-apart configuration by a brace comprising:

top and bottom transom beams perpendicularly connected to said pillars; and left and right strut beams obliquely connected to said transom beams.

8. The combination of claim 7, wherein said brace further comprises:

a middle transom beam mounted parallelly to said top and bottom transom beams, and between said strut beams.

9. A shoring pillar intended for use in combination with one or more screw-jacks each comprising a spindle engaged into a manually actionable bearing nut which consists of a length of hollowed tubular extrusion having a peripheral bearing wall and a plurality of radial ribs extending inwardly and internally from said bearing wall to define an unencumbered axial channel dimensioned to receive and hold a portion of said spindle in the center of either end section of said section, and a bearing plate capping each end section, said plater lying in a plane normal to the axis of said length of tubular extrusion, and having the shape of a washer, an external diameter generally commensurate with the outer diameter of said length of tubular extrusion and an internal diameter at least as large as the cross-diameter of said spindle.

* * * * *